United States Patent [19]

Dowzall

[11] 4,364,184

[45] Dec. 21, 1982

[54] INDICIA ALIGNMENT DEVICE

[75] Inventor: Martin E. Dowzall, Wyckoff, N.J.

[73] Assignee: Letraset Corporation, Paramus, N.J.

[21] Appl. No.: 158,445

[22] Filed: Jun. 11, 1980

Related U.S. Application Data

[63] Continuation-in-part of Ser. No. 948,225, Oct. 3, 1978, abandoned.

[30] Foreign Application Priority Data

| | | | |
|---|---|---|---|
| Oct. 4, 1977 | [GB] | United Kingdom | 41246/77 |
| Oct. 3, 1978 | [JP] | Japan | 53-121255 |
| Oct. 3, 1978 | [NL] | Netherlands | 7809995 |

[51] Int. Cl.[3] ..... B43L 13/24

[52] U.S. Cl. ..... 33/447

[58] Field of Search ..... 33/430, 436, 445–447, 33/450

[56] References Cited

U.S. PATENT DOCUMENTS

| | | | |
|---|---|---|---|
| 648,396 | 5/1900 | Eaton | 33/447 X |
| 1,600,545 | 9/1926 | Hooper | 33/437 |
| 2,765,543 | 10/1956 | Crowell et al. | 33/448 |
| 3,131,106 | 4/1964 | MacKenzie | 156/230 |
| 3,212,913 | 10/1965 | MacKenzie | 117/3.1 |
| 3,803,729 | 4/1974 | Jacerra | 35/26 |
| 3,945,141 | 3/1976 | Frost | 40/125 A |

FOREIGN PATENT DOCUMENTS

| | | |
|---|---|---|
| 2345657 | 3/1975 | Fed. Rep. of Germany . |
| 2402998 | 7/1975 | Fed. Rep. of Germany . |
| 7308125 | 10/1973 | France . |

*Primary Examiner*—Charles E. Phillips

*Attorney, Agent, or Firm*—Darby & Darby

[57] ABSTRACT

Apparatus for use in making signs, displays or artwork is described. The apparatus consists of a base board to which a receptor surface or, for example, a sign sheet may be secured. A sheet holder is movably mounted on the base board and removably supports a carrier sheet bearing horizontally aligned rows of indicia formed of dry transfer material in overlying relationship with the receptor surface. The carrier sheet may be slidable on the sheet holder back and forth horizontally across the receptor surface. The sheet holder is mounted to move vertically across the receptor surface in equal size steps between successive registered positions. The distance between the base line of successive rows of indicia on the carrier sheet is an integral multiple of the sheet holder step size so that when letters are successively transferred from different lines of the carrier sheet to the same line on the receptor surface, those letters are accurately level with one another and in proper horizontal alignment. Several arrangements for moving the sheet holder vertically in predetermined size steps are disclosed.

1 Claim, 8 Drawing Figures

INDICIA ALIGNMENT DEVICE

This application is a continuation-in-part of copending application Ser. No. 948,225 filed Oct. 3, 1978 now abandoned.

This invention relates to apparatus for use in making signs, displays or artwork.

In our copending application, various methods of applying indicia to a work piece are disclosed. In those methods, use is made of dry transfer lettering or carrier sheets from which letters or symbols are transferred to make up the desired legend or format. On such sheets several copies of each letter is the alphabet (and each digit from 0–9) are commonly printed in horizontally aligned rows on a transparent carrier sheet. Thus, the first row may contain 3 each of the letters A-C, and the row beneath may contain 3 each of the letters D-F etc. When preparing a sign using such a dry transfer sheet it is often necessary to apply successive letters from different horizontal rows to create a particular word. Thus, in the situation discussed above, formation of the word FAD would require the operator to transfer letters in sequence from the second, first and second rows of the dry transfer sheet.

It is important, in order that the sign is visually pleasing, for the letters to be properly spaced or aligned both vertically and horizontally on the receptor surface of the work piece. In laying down a sequence of letters from a dry transfer lettering sheet onto a substrate or receptor surface such as a board or paper, it is customary to work to a base line drawn thereon to ensure proper alignment of the letters being applied. However, where the letters are laid onto a plastic sheet, film, foil or the like, it is often impractical to use such a method, to achieve alignment and other means must be adopted. Absent a horizontal (base) line, on the receiving surface accurate alignment of letters from different horizontally arranged rows is difficult to achieve. Precise alignment of indicia under these conditions is tedious, time consuming and often unsuccessful. Heretofore, lettering equipment for enabling the dry transfer application of letters or symbols to a receptor surface regardless of whether base lines may be drawn on the surface itself has not, as a practical matter, been available in the art.

Accordingly, the present invention provides apparatus for use, in particular, in creating signs using dry transfer indicia which comprises a base board on which an indicia receptor surface or sheet may be located, a sheet holder extending horizontally across the board and surface and movable vertically across the surface from top to bottom thereof, means for registering such vertical movement of the sheet holder into a plurality of predetermined equal size steps, a transfer sheet having a plurality of lines or rows of transferable indicia thereon formed the baseline of the indicia in vertically adjacent rows of indicia is an integral multiple of the predetermined sheet holder steps, means for attaching the sheet of transfer material to the sheet holder with the rows of letters on the sheet being parallel to the sheet holder, and means enabling the carrier sheet to be moved horizontally back and forth across the receptor surface, as desired.

Such apparatus may be used to rapidly and easily lay down a horizontally aligned set of letters or indicia on a desired substrate (e.g. indicia receiving surface) which, for example, may consist of a sheet of paper board, metal or plastic. Because the spacing between the base of the indicia arrayed in horizontal rows on the sheet of dry transfer material is an integral multiple of the predetermined equal size steps by which the sheet holder can be indexed up or down vertically across the baseboard, horizontal letter alignment on the receiving surface is easily achieved even though letters are chosen from different lines.

Preferably a fine infinitely variable vertical adjustment is provided between the sheet holder and the base board to enable the position of the base line of the line of letters transferred to be adjusted. The maximum vertical adjustment with this control is usually equal to the size of a single thread pitch as it is intended to make only minor vertical corrections. Fine adjustment of the transfer sheet can then be achieved with this control. It is often necessary to make a fine vertical adjustment of the sheet holder to get perfect superposition of the indicia rows on the transfer sheet over the line on the receiving surface to which the indicia are to be transferred. This adjustment distance is usually less than one thread pitch width. Hence, rough positioning of the transfer sheet over the receiving surface is done by rapid movement of the rule vertically along successive pitches, and fine adjustment is thereafter made with the variable adjustment control.

A fine adjustment may also be provided to enable the sheet holder to be pivoted in small increments about a generally circular (radial) path parallel to the plane of the receptor sheet surface to compensate for slight horizontal misalignment of the indicia imprinted on the carrier sheet. The radial movement may amount to a rotation of the rule member up to 5° of arc.

The stepped motion of the sheet holder is preferably achieved by engaging the sheet holder successively in the turns of a constant pitch thread. A suitable thread pitch is 3 mm as the distance between the baseline of the indicia in successively horizontal rows is generally an integral multiple of 3 mm (i.e. 36 mm, 39 mm, 42 mm).

The vertical stepped motion may be achieved for example by providing any mechanical device or rider fixed to the sheet holder which will engage the thread. Preferred is a spring-loaded ball catch adapted to rest in or engage the thread. In one embodiment, the ball is captive and can be disengaged from the thread by hinging the sheet holder about an axis parallel to its vertical direction of movement. This allows the sheet holder to be swung out of the way while a sign plate or other material is being affixed to or removed from the base board.

Alternative stepped motion or indexing systems can be used. For example, the sheet holder may bear a catch engageable with one of a series of holes in a spacing bar. The size of step could be varied by changing the spacing bar or by providing two or more tracks on the bar having holes at different pitches. The bar or the ball on the sheet holder could be moved to vary the step size. Where desired, movement of the sheet holder may be controlled by one or more electric motors such as conventional stepping or linear motors which will provide the necessary indexing increments.

In another arrangement a spring biased catch connected to a solenoid is used to engage the thread pitch. The catch is withdrawn by electrically actuating the solenoid to permit chatter-free noiseless vertical movement of the sheet holder.

Yet a further alternative stepped motion system is to provide the sheet holder and the base board with similarly aligned strips of magnetic material in which the polarity of the magnetism is arranged stripwise, i.e. the surface of the magnetic material is divided into a plurality of narrow parallel fields of alternate north and south polarity. By placing a strip of such material on the underside of the sheet holder and setting such material into the surface of the base board, the sheet holder and base board may be held aligned by alignment of the magnetized segments and will be held together only when north pole segments of one piece of material face south pole segments of the other.

Horizontal sliding of the sheet can be achieved by mounting the sheet on the sheet holder via a slider or cursor member which slides along the length of the sheet holder. Alternatively, the sheet may be non-slidably mounted on the holder and the latter may be mounted on the base board in such a way that it can be slid horizontally.

Figure 1:
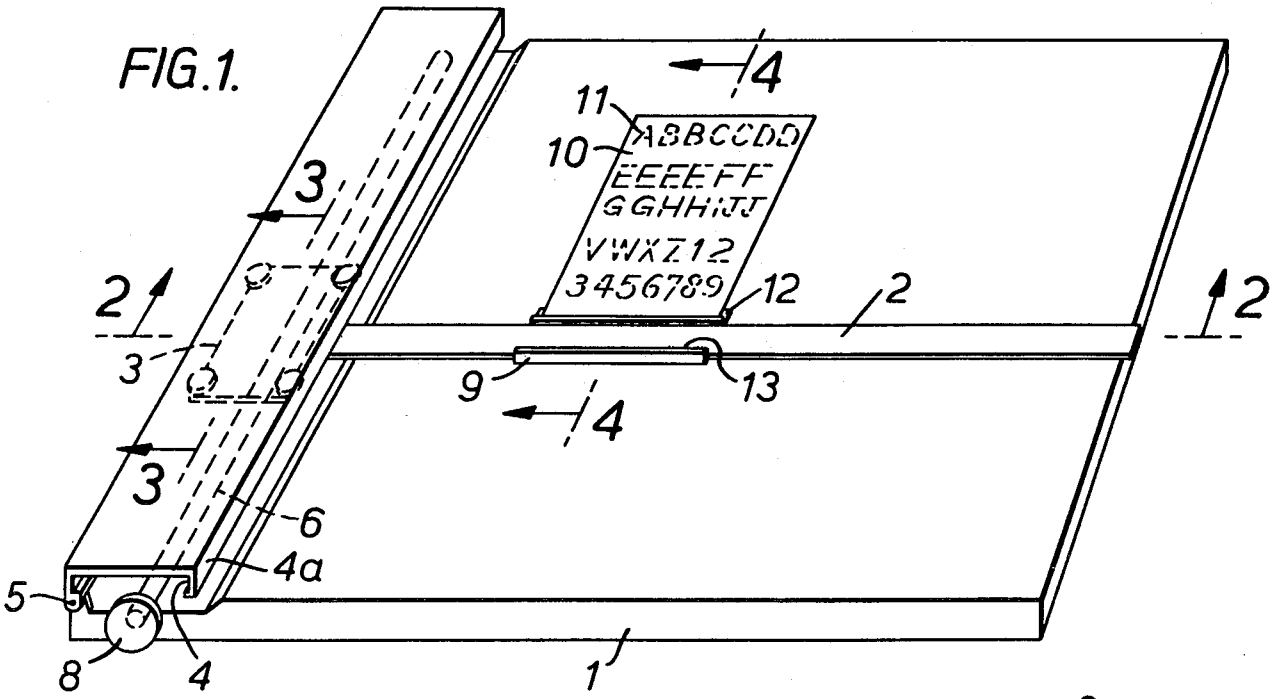
FIG. 1 is a perspective view of one embodiment of the the present invention.
Figure 2:
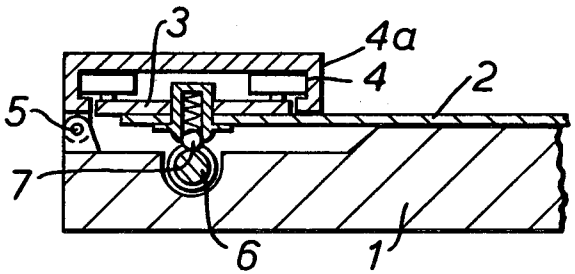
FIG. 2 is a partial sectional view taken along the lines 2—2 in FIG. 1.

Referring to FIGS. 1 and 2, the apparatus comprises a base board 1 to which a suitable receptor sheet may be affixed, e.g. with masking tape or double sided adhesive tape. A rule 2 extends horizontally across the upper surface of the receptor sheet. The rule 2 is mounted on a carriage 3 connected to the baseboard. Carriage 3 runs in an accurately straight channel 4 formed along the undersurface of a guide member 4*a* hingedly mounted at 5 on one edge of the board 1.

Figure 3:
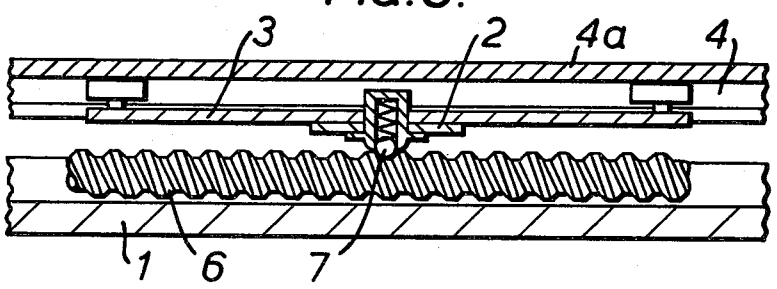
FIG. 3 is a partial sectional view taken along the lines 3—3 of FIG. 1.

Below carriage 3 and parallel to channel 4 is a threaded rod 6. The pitch of the threads is 3 mm. The carriage 3 carries a spring loaded captive ball 7 (seen best in FIG. 3) which, when the rule 2 lies on board 1, engages in threaded rod 6. Rod 6 is rotatably mounted in the end of board 1 and can be rotated by turning a handle 8 mounted on one end. As handle 8 is turned, rule 2 accordingly moves up or down board 1, at a rate of 3 mm per revolution of handle 8. A peg on the baseboard (not shown) limits rotation of handle 8 to a single 360° revolution.

Figure 4:
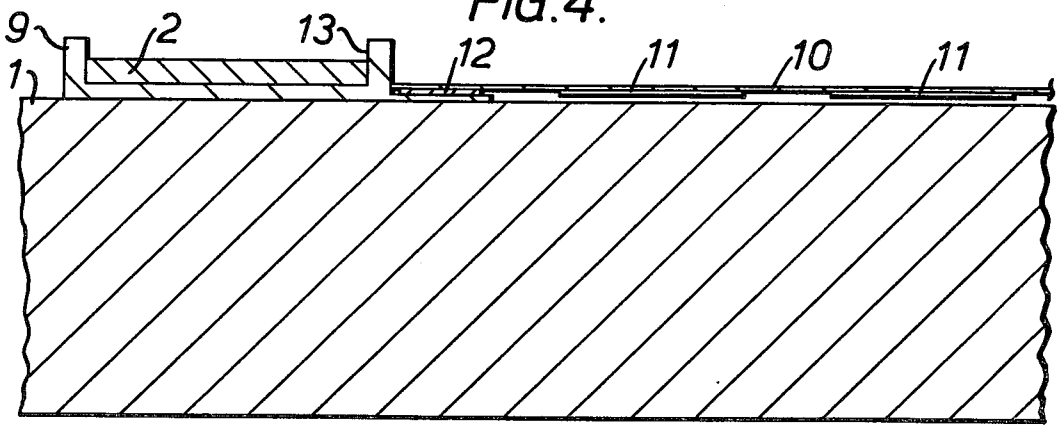
FIG. 4 is a view taken along the line 4—4 of FIG. 1.

With reference to FIGS. 1 and 4, a cursor 9 is slidably located on rule 2 to move back and forth longitudinally along the length of the rule. A sheet 10 containing a plurality of lines or rows of indicia 11 formed of dry transfer material is removably affixed to the cursor in any suitable way such as by adhesive tape 12 or by a clamp (not shown). In the present embodiment, the cursor is substantially U-shaped in cross section to form a guide channel 13 which can slidably engage the rule. The cursor may slide along the upper or lower surface of the rule, as desired. The spacing between the base of the indicia in each of the horizontally arrayed lines of indicia on sheet 10 is an integral multiple of 3 mm (e.g. 39 mm, 36 m, 42 mm, or the like). Not all the lines need to be equally spaced, but the distance between the baseline of indicia in different horizontal lines must always be an integral multiple of the thread pitch (3 mm).

In use, rule 2 is first swung up about hinge 5 and out of the way and the receptor sheet is affixed to board 1. The rule is then swung down, whereupon the ball 7 automatically centers into a thread on rod 6. Cursor 9 with a sheet 10 attached is then placed on rule 2 and the exact desired vertical position of the rule 2 initially adjusted by turning the handle 8. Thereafter, successive letters are transferred to the receptor sheet on board 1 by moving the rule 2 up and down in predetermined steps equal to the thread pitch on rod 6 and sliding the cursor 9 to left and right to bring the desired letter into the correct position. Precise vertical alignment is ensured by the spring loaded ball apparatus. Correct horizontal spacing may be achieved by using dry transfer lettering sheets bearing lateral spacing marks associated with each letter, e.g. as described in British patent specification No. 1,073,065.

Figure 5:
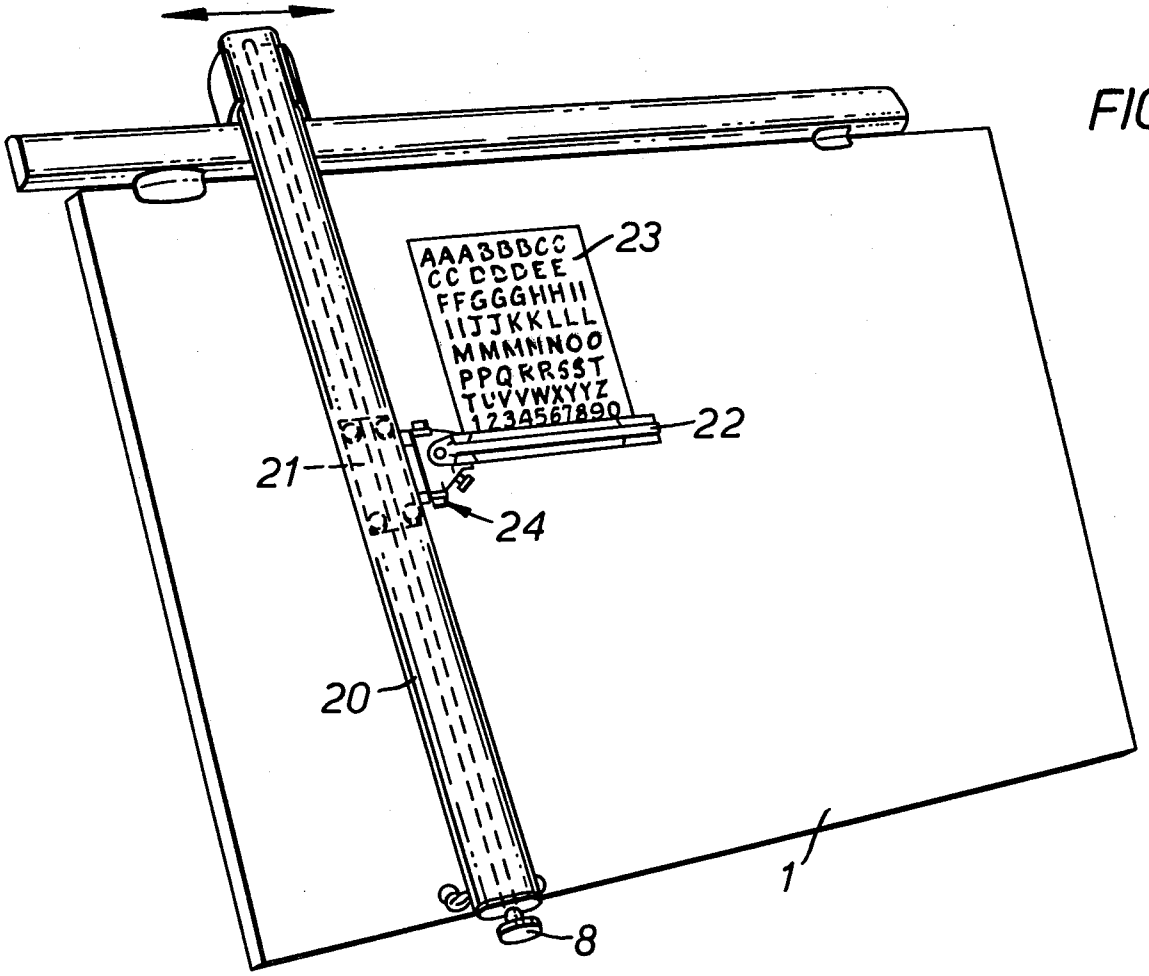
FIG. 5 is a perspective view of an alternate embodiment of the present invention.

FIG. 5 shows a modified version with like parts being designated by like reference numbers. The fixed swingable guide member 4 is, however, replaced by a vertical bar 20 slidably mounted for horizontal movement across the surface of the board. A carriage 21 is slidably mounted for indexed movement along the length of the bar 20 from top to bottom of the board. A rule 22 is pivotably connected to the carriage 21 by a hinge mechanism 24 and extends horizontally across the surface of the board. Sheets 23 containing dry transfer lettering, one lower case and one upper case letters, are affixed, e.g. by masking tape or clamp (not shown) to the horizontal rule 22. Carriage 21 can engage in a plurality of equal vertically spaced apart positions by a spring-loaded ball constantly engaging in a threaded rod in bar 20 as described above in connection with FIG. 1. A handle 8 allows an initial fine adjustment of the vertical position as set forth above.

Figure 7:
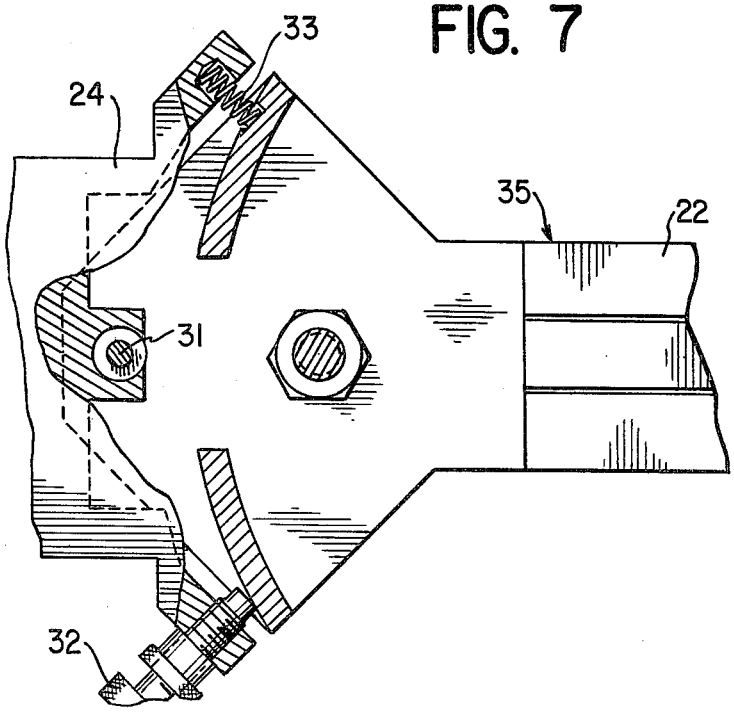
FIG. 7 is an enlarged cut away view of a portion of the apparatus of FIG. 6.

In a preferred embodiment, the rule 22 may be connected to the carriage 21 so as to pivot in a horizontal plane parallel to the receptor sheet surface. A micrometer mechanism or cam (as shown for example in FIG. 7 at 32) may be employed as part of the carriage 21 to adjust the position of the rule 22 in the horizontal plane for final axial alignment of the indicia to be transferred.

Figure 6:
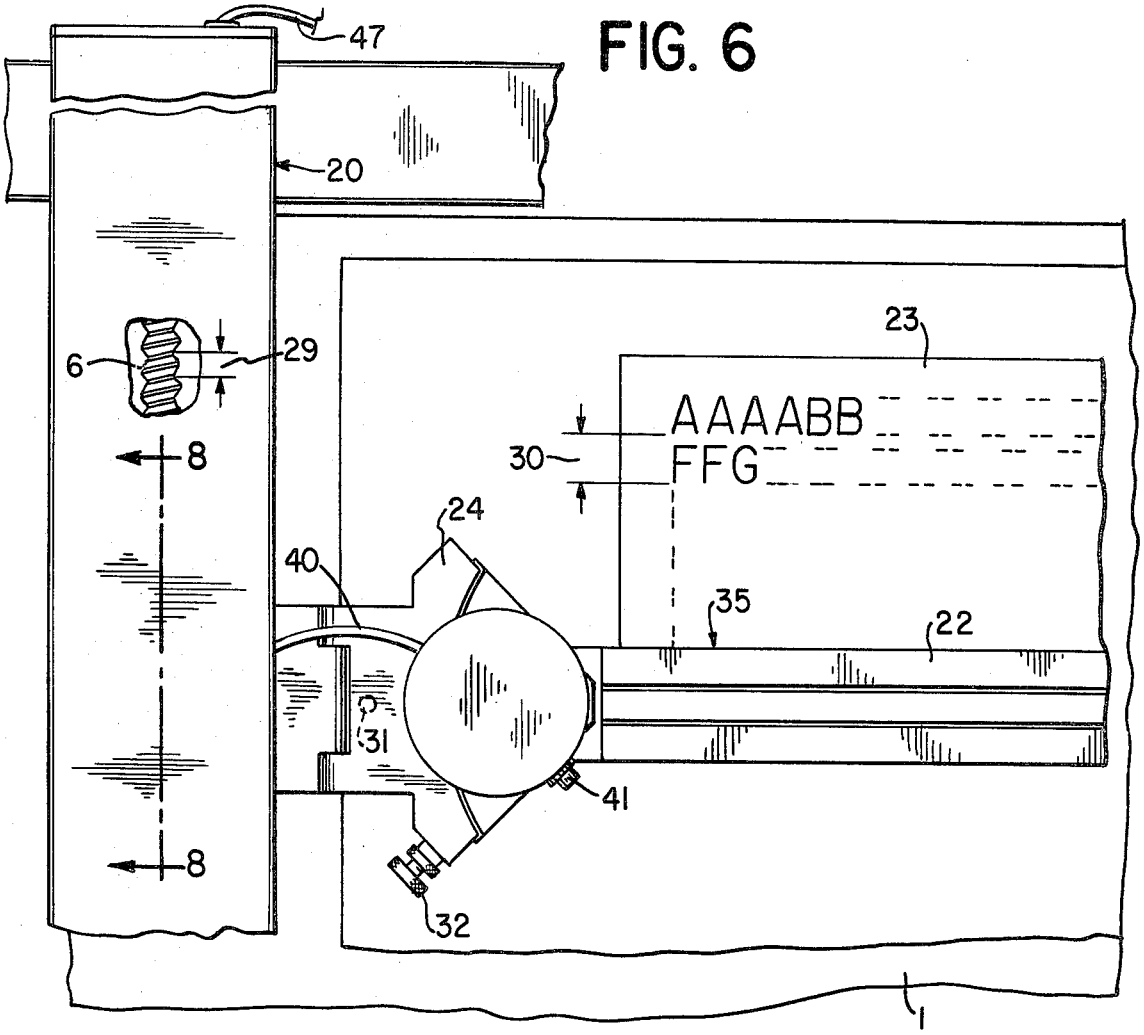
FIG. 6 is a plan view of a further embodiment of the present invention.

FIG. 6 depicts a preferred embodiment of the apparatus of the invention which is a variant of the device illustrated in FIG. 5 with like parts being designated by like reference numbers.

The sheet holder or rule 22 may be moved vertically along rod 6 in predetermined steps of equal size. The size of each stepwise movement is equal to the size of the thread pitch 29 of rod 6.

The thread pitch or distance between adjacent valleys on the threaded rod 6 is shown at 29. The distance 30 between the baseline of adjacent horizontal rows of indicia is an integral multiple of thread pitch 29. Rule 22 is pivotable about fixed pin 31. The device includes an adjustment screw 32 which may be rotated to move the rule 22 in a generally radial path about the axis of the fixed pin 31. Spring 33 set into the base 34 of hinge mechanism 24 normally biases the rule against the front face of adjustment screw 32 to provide a stationary alignment. Rotation of the adjustment screw 32 provides a maximum radial displacement of the rule 22 through about 5° of arc. This permits the horizontal alignment of rule 22 to be adjusted about a radial path to compensate for slight horizontal misalignments which may occur when the sheet 23 is secured to rule 22. This adjustment is usually required to be made only once, when the operator has placed a new transfer sheet 23 on rule 22. The rule 22 is equipped with a magnetic clamping arrangement illustrated generally at 35 to hold the transfer sheet 23 in position, although the sheet may also be secured in position on rule 22 with masking tape, protruding pins or the like.

Figure 8:
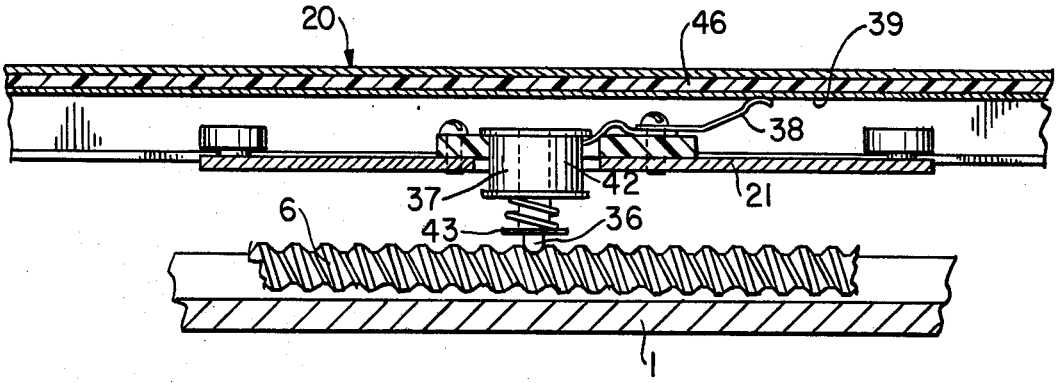
FIG. 8 is a sectional view taken along the line 8—8 of FIG. 6.

Referring to FIGS. 6 and 8 a solenoid actuated detent arrangement is illustrated. The threaded rod 6 is mounted to rotate above the base of the board 1. A spring loaded detent arm 36 mounted above the rod 6 engages the thread pitch to hold the rule 22 in a stationary position on the vertical axis. Detent 36 is biased against the thread pitch by spring 37. An electrically actuated solenoid 42 is mounted on the carriage 21 that is beneath bar 20. The solenoid 42 is electrically connected by a pair of spring tension terminals 38 (only one of which is shown) to a pair of electrically conductive tracks 39 (only one of which is shown) running the length of bar 20. A layer of plastic 46 insulates the tracks from bar 20. An electric cable 40 runs from the track terminals within bar 20 to a switch 41 located at the base of rule 22. Cable 47 connects the solenoid 42 thru switch 41 to an electric power source. When the operator depresses switch 41, the solenoid 42 is actuated and pulls in the detent 36 thereby permitting rule 22 to be freely moved vertically with carriage 21 beneath bar 20. As the detent 36 is withdrawn, there is no noise or mechanical chatter when the rule 22 is advanced vertically in either direction. When the rule has reached the desired position, the operator releases button 41 and thereby breaks the circuit to solenoid 42. This causes the detent 36 to be biased back into engagement with the underlying thread pitch due to the action of spring 37 against detent plate 43. The detent 36 is automatically and firmly centered in the nearest underlying thread pitch by the spring 37. As switch 41 is mounted on the base of rule 22, the operator can release the rule for free movement along the vertical axis of bar 20 without removing his hand from the rule.

In use, sheets 23 are engaged in the magnetic clamp 35 or with masking tape (not shown) to the horizontal rule 22. The lead screw 32 is rotated to obtain precise horizontal alignment of the indicia on sheet 23 with the receiving surface. Thereafter, the rule 22 is released from engagement with the threaded rod 6 by depressing button 41. The rule is moved vertically to overlay the desired position on the receiving sheet along carriage 21 and button 41 is then released. This causes detent 36 to firmly engage and center in the underlying thread pitch of rod 6. Rule 22 is still movable in steps equal to the pitch of the threaded rod 6, but the solenoid actuated detent permits large scale vertical movements to be accomplished easily, without the noise and vibration that normally accompany movement of a spring loaded ball as in the apparatus of FIG. 5.

The apparatus of the invention provides repeatable positioning accuracy of ±0.002" for locating dry transfer indicia on receiving surfaces. Manipulation of the lead screw makes it possible to make positioning adjustments of as little as 0.001" to facilitate precise horizontal alignment of transferred indicia on a receiving surface.

What is claimed is:

1. Apparatus for use in applying dry transfer indicia in precise horizontal alignment to an indicia receiving surface comprising:

a baseboard on which said receiving surface is positioned, a rule member positioned above said receiving surface and movable along a vertical axis substantially parallel to the plane of said receiving surface, means for slidably mounting a dry transfer sheet containing a plurality of horizontally arranged rows of said dry transfer indicia printed thereon on the rule member to move back and forth longitudinally along said member, means for the stepwise vertical movement of the rule for a preset fixed distance along said vertical axis into any of a plurality of spaced apart stops, means for pivoting said rule member in a generally radial path in the plane of said baseboard and about a pivot pin fixed to a stationary base member to which said rule is connected comprising a threaded screw bearing against a face of said rule member and a spring in said base biasing said rule member against said screw, the rotation of said screw urging said rule member to move in a radial path about said pivot pin and against the urging of said spring, and the vertical distance between the base line of the indicia in vertically adjacent rows being an integral multiple of said preset fixed distance to allow transfer of individual indicia in horizontally aligned relationship from any of the plurality of rows of indicia on the transfer sheet to the receiving surface.

* * * * *